United States Patent [19]

Perry et al.

[11] 4,258,784

[45] Mar. 31, 1981

[54] HEAT EXCHANGE APPARATUS AND METHOD OF UTILIZING THE SAME

[75] Inventors: Clifford R. Perry, Renton; Lloyd H. Dietz, Seattle, both of Wash.

[73] Assignee: The Boeing Company, Seattle, Wash.

[21] Appl. No.: 894,252

[22] Filed: Apr. 7, 1978

[51] Int. Cl.[3] ..... F28F 3/08

[52] U.S. Cl. ..... 165/166; 29/157.3 D

[58] Field of Search ..... 165/166, 167

[56] References Cited

U.S. PATENT DOCUMENTS

| | | | |
|---|---|---|---|
| 2,511,084 | 6/1950 | Shaw | 165/166 |
| 2,617,634 | 11/1952 | Jendrassik | 165/166 X |
| 2,686,154 | 8/1954 | MacNeill | 165/166 X |
| 3,216,492 | 11/1965 | Weaver | 165/166 X |
| 3,444,926 | 5/1969 | Stulberg | 165/166 |
| 3,733,244 | 5/1973 | Sanberger et al. | 165/166 |

*Primary Examiner*—Samuel Scott
*Assistant Examiner*—Theophil W. Streule, Jr.
*Attorney, Agent, or Firm*—Hughes, Barnard & Cassidy

[57] ABSTRACT

A plurality of horizontally positioned plates stacked on top of one another, with thin film plastic sheets separating each adjacent pair of plates. Each plate is formed with a substantially identical, horizontally extending, vertically through passageway, with the sheets separating the passageways of each plate. Upper and lower pressure plates, provided with pressurized air bags, maintain uniform pressure across the plates to prevent leakage from the passageways. Manifold devices at opposite ends of the passageways direct a first heat exchange medium through a first set of vertically alternate passageways, and direct a second heat exchange medium through a second set of vertically alternate passageways positioned intermittently with respect to the first set of passageways.

8 Claims, 5 Drawing Figures

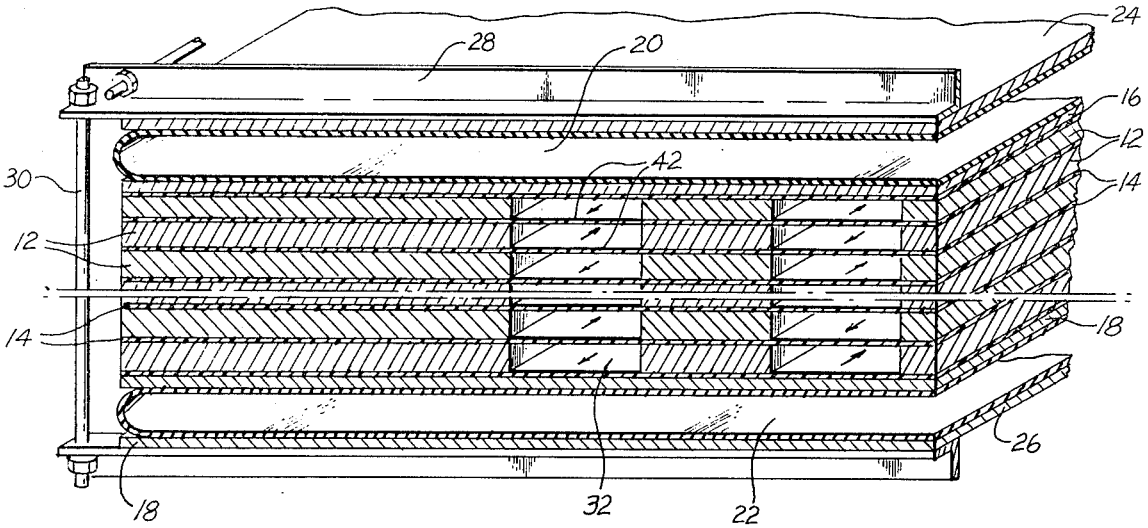
FIG. 3
FIG. 4
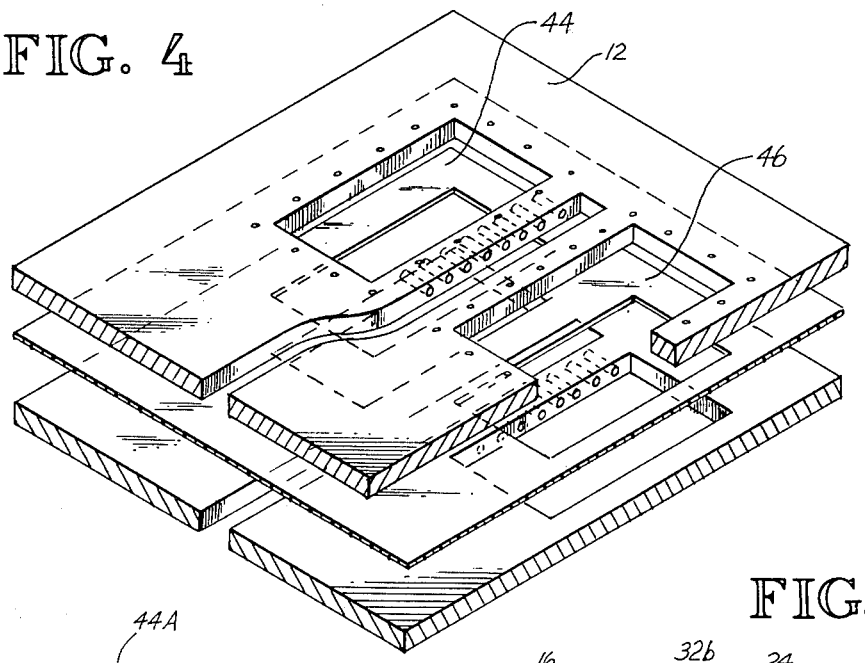
FIG. 5
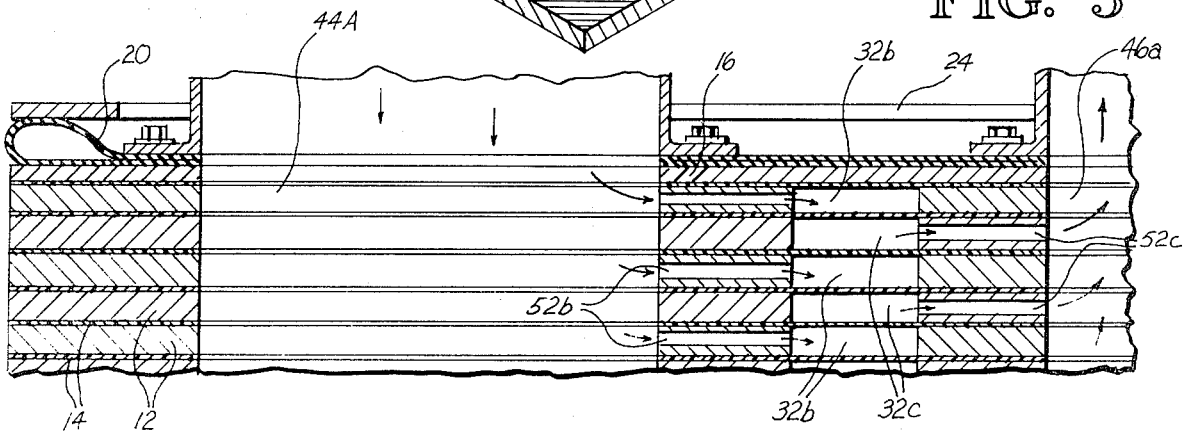

HEAT EXCHANGE APPARATUS AND METHOD OF UTILIZING THE SAME

BACKGROUND OF THE INVENTION

A. Field of the Invention

The present invention relates to a heat exchanger, and a method of utilizing the same.

B. Brief Description of the Prior Art

Since the present invention is well adapted for use in conjunction with heat exchange systems where saline or brackish water is converted to potable water, the general state of the prior art with regard to heat exchangers will be given consideration with reference to such systems. A common arrangement for such systems is to employ two distinct heat exchangers. The first heat exchanger is generally a counterflow heat exchanger and is used to place the brine which is initially flowing into the system in heat exchange relationship with the potable water flowing from the system to transfer the heat from the potable water to the incoming brine and raise its temperature from ambient temperature to a higher temperature, possibly in the order of 200° F. or so. The second heat exchanger is a condenser/evaporator type heat exchanger where the brine is pumped to the upper end of the heat exchanger and caused to fall as a thin film over one side of a set of heat exchange surfaces. At the same time, steam which is derived by heating the brine is compressed to a higher pressure and exposed to the opposite side of the heat exchange surfaces to be in heat exchange relationship with the brine film. This causes potable water to condense on the second set of surfaces and also causes evaporation of water from the brine flowing downwardly on the opposite side. This condensed water is collected and passed out through the first counterflow heat exchanger to raise the temperature of the incoming brine as described above.

In general, there have been two common arrangements for the elements which provide the heat exchange surfaces. One is to provide a plurality of plates arranged parallel to one another and spaced a short distance from each other, so that a plurality of adjacent passageways are formed by the various sets of plates; this is commonly called a flat plate heat exchanger. One heat exchange medium is directed through a first set of alternately spaced passages, while the second heat exchange medium is directed through the second set of passageways spaced intermittently with the first set. Thus, heat is transferred from one heat exchange medium to the other through the plates.

The second general arrangement for heat exchangers is to provide the heat exchange elements in the form of elongate tubes which extend through a heat exchange chamber and are spaced a moderate distance from one another. One heat exchange medium is directed into the interior of the tubes, while the other heat exchange medium is directed into the area between and around the outside of the tubes. In some instances, the second heat exchange medium flows in a direction transverse to the longitudinal axes of the tubes, and in other arrangements, the second heat exchange medium is directed parallel to the longitudinal axes of the tubes.

Since one of the main factors influencing the effectiveness of the heat exchanger is the heat transfer characteristics of the material separating the two heat exchange mediums, it has been quite common to fabricate the heat exchange elements from a metal which has a high thermal conductivity. However, for massive heat exchange installations, such as those used in producing potable water from saline water, the cost of providing and maintaining heat exchange elements in a quantity and size necessary to provide the heat exchange surface required, is a significant factor in determining whether the overall heat exchange system is economically feasible. This becomes particularly critical where metal is used as the material for the heat exchange elements, since the fabrication and installation of a vast number of metallic heat exchange elements can become a substantial portion of the cost of the entire system.

Accordingly, there have been attempts in the prior art to fabricate the heat exchange elements from other materials, and one of the results is research and development work in thin plastic film heat exchangers. Since plastic, in comparison to metal used in heat exchangers, is a relatively poor conductor of heat, for such films to operate with reasonable effectiveness, it is necessary to make the films quite thin to obtain adequate transfer of heat. The result is that the film material is generally relatively flexible and fragile in comparison to comparable metal heat exchange structures. When the thin film plastic is arranged as planar sheets to form the heat exchange surfaces (in the general configuration of metal panels), it becomes difficult to maintain the sheets in proper spaced relationship with respect to one another. One of the reasons for this is that to operate the heat exchanger, either as a counterflow heat exchanger or an evaporative type heat exchanger it is generally necessary to have at least some pressure differential between the two heat exchange mediums.

It has also been attempted in the prior art to provide thin film plastic heat exchangers in the form of tubular heat exchange elements. This alleviates to some extent the problem posed by pressure differential between the heat exchange mediums, since the higher pressure heat exchange medium can be directed into the interior of the tubes which are then caused to assume a generally circular configuration in response to the internal pressure. However, for practical commercial operation, these tubes must be provided in relatively long lengths, and there are quite often problems of instability in the tubes oscillating or becoming positioned against one another in response to the influence of the flow of the heat exchange medium or mediums either through or around the tubes. Not only does this create problems in preserving the structural integrity of the heat exchange structure, but it also creates a problem in the optimization of the heat transfer characteristics of the heat exchanger.

With regard to the various heat exchange devices shown in the literature of United States patents, the following are noted:

U.S. Pat. No. 1,955,261, Tryon et al, shows a heat exchanger where there are a plurality of tubes which are arranged in an alternating pattern and cast into a block made of a suitable metal, such as aluminum or copper.

U.S. Pat. No. 2,347,957, McCullough, shows a heat exchanger comprising a tubular member arranged in a circuitous pattern and having a number of fins extending therefrom to improve heat transfer.

U.S. Pat. No. 3,161,574, Elam, shows a condenser type heat transfer device where thin film plastic tubes are used as the heat exchange elements. Pressurized steam is directed into the interior of the tubes, and brine is directed as a film over the outside surface of the tubes.

U.S. Pat. No. 3,315,740, Withers, shows a heat exchanger made up of a tube bundle. The ends of the tubes are gathered together in a manner to form a fluid tight end portion of the tubular heat exchanger.

U.S. Pat. No. 3,493,040, Davison, shows a plate type heat exchanger where the plates are formed with dimples to provide for proper spacing of the plates.

U.S. Pat. No. 3,537,935, Withers, shows a heat exchanger formed with plastic tubes, with one heat exchange medium being directed through the tubes and the other heat exchange medium being directed along a path transverse to the lengthwise axis of the tubes, commonly called a crossflow heat exchanger.

U.S. Pat. No. 3,616,835, Laurenty, is generally representative of a flat plate type heat exchanger.

U.S. Pat. No. 3,790,654, Bagley, teaches a method of extruding thin-walled honeycombed structure. While the teaching of this patent is not directed specifically toward heat exchangers, it does state that such honeycomb structures are used in regenerators, recuperators, radiators, catalyst carriers, filters, heat exchangers and the like.

U.S. Pat. No. 3,825,460, Yoshikawa et al, shows a carbonaceous honeycomb structure where tubular-like elements are formed into a variety of structures having elongate passageways, some of which are triangular, some of which are circular, and some of which are hexagonal.

U.S. Pat. No. 3,926,251, Pei, shows a counterflow heat exchanger where circular tubes are laid down, then expanded into contact with one another. In one embodiment, the tubes are arranged in a pattern so that the end passageways are formed as squares. In another configuration the tubes are arranged so that the end configuration of the passageways are hexagonal.

U.S. Pat. No. 3,948,317, Moore, discloses glass-ceramic tubes which are formed into a honeycomb configuration for use as heat exchangers.

U.S. Pat. No. 3,983,283, Bagley, discloses a ceramic honeycomb structure for use as a catalytic converter or heat exchanger.

U.S. Pat. No. 4,002,040, Munters, shows a cross-current heat exchanger, where an airstream is cooled by evaporating moisture into a second air stream placed in heat exchange relationship with the first air stream.

U.S. Pat. No. 4,029,146, shows several configurations of a corrogated metal panel used as a heat exchanger.

The following patents are noted as broadly representative of various prior art devices: U.S. Pat. Nos. 2,820,744, Lighter; U.S. 3,168,450, Black; U.S. 3,239,000, Meagher; U.S. 3,367,843, Clive et al; U.S. 3,396,785, Kirsch; U.S. 3,428,529, Gumucio; U.S. 3,672,959, Sweet; U.S. 3,703,443, Evans; and U.S. 3,929,951, Shibata et al.

SUMMARY OF THE INVENTION

The apparatus of the present invention is adapted to place a first fluid medium into heat exchange relationship with a second heat exchange medium. The apparatus comprises plurality of spacing plates, each of which is formed with a vertically through, horizontally extending passageway. Each of these passageways is arranged in a substantially identical pattern, and the plates are stacked above one another in longitudinal and transverse alignment, so that the passageways are arranged one directly above the other. Each of the passageways has a first end and a second end.

A plurality of thin film plastic sheets are positioned intermittently between the spacing plates, with one sheet between each adjacent pair of spacing plates. Thus each passageway is separated by a related pair of these sheets from the passageways immediately above and below.

There is a distributing means for directing said two heat exchange mediums into said passageways; this comprises a first manifold means connected to the first end of the first set of alternately spaced passageways, a second manifold means connected to the first ends of a second set of alternately spaced passageways positioned alternately between the passageways of the first set, a third manifold means connecting to the second ends of the first set of alternately spaced passageways, and a fourth manifold means connecting to the second ends of the second set of alternately spaced passageways. With this arrangement, the first heat exchange medium is directed through the first set of alternately spaced passageway by means of the first and third manifold means, and the second heat exchange medium is directed through the second set of alternately spaced passageways by means of the second and fourth manifold means, with heat exchange taking place across sheet portions separating vertical adjacent passageways.

The manifold means can be provided quite conveniently by forming a plurality of vertically aligned through openings in the spacing plates, with each aligned set of openings forming a unitary manifold chamber. Each set of alternate spacing plates is provided with feed passage means leading from its two manifold means into its related set of alternately spaced passageways.

There is pressure means to press the spacing plates toward one another, this pressure means comprising containing means having a pressurized fluid medium which in turn exerts pressure against the spacing plates. In the preferred form, the pressure means comprises at least one air bag having pressurized air therein, this air bag having a pressure surface pressing these spacing plates against one another. There is a first contact plate pressing against the spacing plates and a second pressure plate spaced from the contact plate. The air bag is positioned between the contact plate and the pressure plate, and the pressure plate is pressed against the air bag by suitable means so that a substantially uniform pressure is transmitted to the spacing plates by the air bag acting through the contact plate.

In the particular configuration of this preferred embodiment, each passageway is arranged in a plurality of longitudinally extending passageway sections, connected one to another in series relationship, with each of the passageway sections being longitudinally arranged in adjacent parallel relationship.

In the method of the present invention, there is first provided a heat exchange apparatus such as that described above. The first heat exchange medium is directed through the first set of alternately spaced passageways. The second heat exchange medium is directed through a second set of alternately spaced passageways. Thus, the first heat exchange medium is placed in heat exchange relationship with the second heat exchange medium, with heat exchange taking place across sheet portions separating adjacent passageways.

In one arrangement, the two heat exchange mediums are passed through the heat exchange apparatus in counterflow relationship. In another arrangement, the two heat exchange mediums are passed through the apparatus and coflow relationship. Other features of the present invention will become apparent from the following detailed description.

BRIEF DESCRIPTION OF THE DRAWING

FIG. 3 is a sectional view taken along line 3—3 of FIG. 1;

FIG. 4 is an isometric view of the corner sections of two spacing plates, along with a portion of the thin film sheet separating the two, at the location of two of the manifold devices of the apparatus of FIG. 1;

FIG. 5 is a sectional view taken along 5—5 of FIG. 1, showing that portion of the apparatus shown in FIG. 4.

DESCRIPTION OF THE PREFERRED EMBODIMENT

Since the present invention is particularly adapted for use as a counterflow heat exchanger in a large scale operation of converting saline water to fresh water, the following description will be directed particularly toward that application. However, it is to be understood that within the broader aspects of the present invention, it could be utilized in other related applications.

Figure 1:
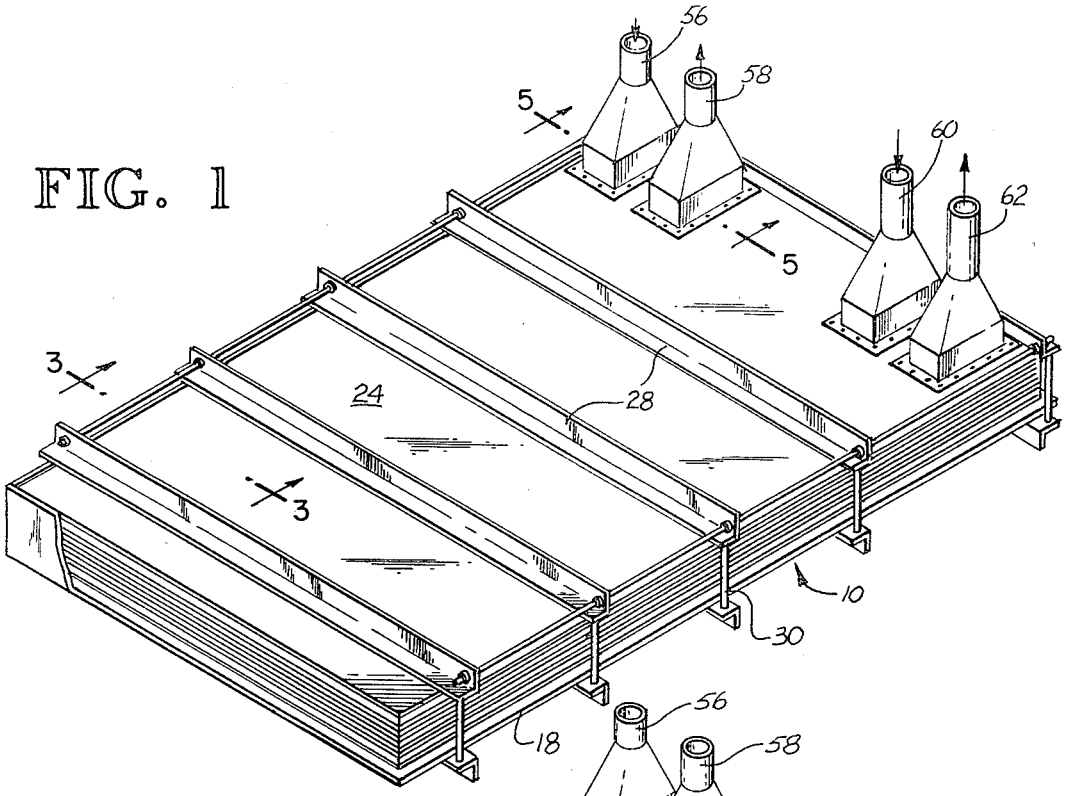
FIG. 1 is an isometric view of the heat exchange apparatus of the present invention.

The heat exchange apparatus 10 is shown in its assembled condition in FIG. 1. This apparatus 10 comprises a plurality of horizontally disposed spacing plates 12, with each pair of spacing plates 12 being separated by a related one of a plurality of thin film plastic sheets 14. The plates 12 each have a substantially uniform thickness dimension, and they are pressed against one another with substantially uniform pressure along substantially their entire horizontal surfaces. To accomplish this, there is provided an upper contact plate 16 positioned directly above and pressing downwardly on the uppermost spacing plate 12, and a lower contact plate 18 positioned below and pressing upwardly against the lower most contact plate 12. Immediately above the top contact plate 16 is a pressurized air bag 20 which extends over substantially the entire surface of the top contact plate 16. A second air bag 22 is similarly disposed below the lower contact plate 18. An upper pressure plate 24 lies against substantially the entire upper surface of the upper air bag 20, and a lower pressure plate 26 is positioned below the lower air bag 22.

A plurality of transversely extending bars 28, spaced longitudinally from one another at regular intervals along the length of the apparatus 10, is provided above and below the upper and lower pressure plates 24 and 26, respectively. Each pair of vertically aligned bars 28 are connected by their end portions to one another by means of vertically aligned bolts 30. By tightening the nuts on the ends of the bolts 30, each pair of vertically aligned bars 28 can be pressed toward one another so that the upper and lower air bags 20 and 22 can be pressurized to the desired extent, this resulting in pressure of a predetermined amount being exerted uniformly over substantially the entire horizontal surfaces of the separating plates 12.

Figure 2:
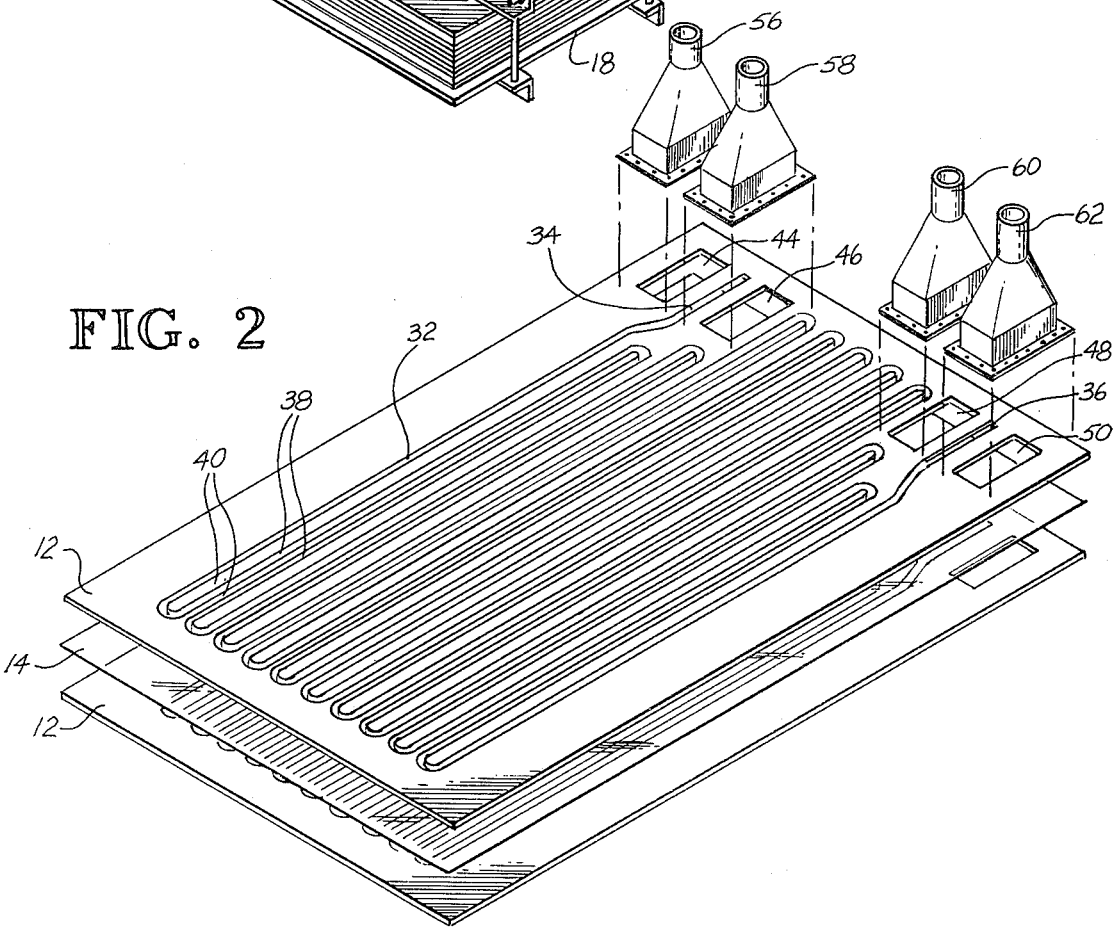
FIG. 2 is an isometric view of two of the spacing plates and one of the plastic sheets of the apparatus shown in FIG. 1, these elements being shown as spaced vertically from one another for purposes of illustration.

As shown herein, the spacing plates 12 have a generally rectangular planar configuration and are substantially identical to one another. With reference to FIG. 2, it can be seen that each spacing plate 12 is formed with a vertically through horizontal passageway 32. The passageway 32 has a first end 34 and a second end 36, and as shown herein the passageway 32 follows a generally serpentine pattern, so that there are a plurality of transversely spaced longitudinally aligned passageway sections 38 connected to one another in series. Thus, each spacing plate 12 has two sets of oppositely extending horizontal arms 40, positioned between one another in alternating relationship, to define the continuous passageway 32. With substantially identical passageways 32 being directly above one another, the only vertical separation between each pair of adjacent horizontal passageways 32 is a related thin film sheet portion 42. (This is best illustrated in FIG. 3).

So that the fluid heat exchange mediums can be introduced into the passageways 32, each spacing plate 12 is provided with four vertically through manifold openings 44,46,48 and 50. The two openings 44 and 46 are positioned on opposite sides of the first end 34 of the passageway 32, and the third and fourth manifold openings 48 and 50 are located on opposite sides of the second end 36 of the passageway 32.

As can be seen in FIG. 5, the sheets 14 are cut away at the manifold openings 44 so that the openings 44 collectively define an open manifold chamber, designated 44*a*, extending substantially the entire depth of the stack of spacing plates 12. It can also be seen in FIG. 5 that the set of second openings 46 collectively define a second open manifold chamber 46*a*. In like manner, the other two sets of openings 48 and 50 form third and fourth manifold chambers 48*a* and 50*a* on opposite sides of the second end 36 of the passageway 32. However, since these third and fourth manifold chambers 48*a* and 50*a* are substantially identical to the manifold chambers 44*a* and 46*a*, these chambers 48*a* and 50*a* are not illustrated herein.

With further reference to FIG. 5, it can be seen that the manifold 44*a* communicates with a first set of alternately positioned passageways designated 32*b*, through lateral openings 52*b* extending through that portion 54 of the spacing plate 12 located between the passageways 32 and the manifold chamber 44*a*. The second manifold chamber 46*a* communicates by means of openings 52*c* with a second set of alternately spaced passageways 32*c*, positioned intermittently between the first set of passageways 32*b*.

Each of the manifold chambers 44*a* through 50*a* is provided with a related conduit fitting, designated 56, 58, 60 and 62, respectively. The upper contact plate 16, the upper air bag 20 and the upper pressure plate 24 are each provided with through openings to permit the conduit fittings 56 through 62 to lead directly into the upper ends of their related manifold chambers 44*a* through 50*a*. In the particular arrangement shown herein, the two conduit fittings 56 and 62 lead directly into the manifold chambers 44*a* and 50*a*, respectively, and these two manifold chambers 44*a* and 48*a* communicate with the same set of alternately spaced passageways 32*b*. The other two conduit fittings 58 and 60 communicate directly with the two manifold chambers 46*a* and 48*a* and communicate with the same second set of alternating passageways 32*c*.

The operation of the apparatus 10 of the present invention will now be described as being used as a counterflow heat exchanger, such as one used to raise the temperature of saline water which is to flow into a condenser/evaporater heat exchange system of a desalinization operation. In such an application, the low temperature saline water is directed through the conduit fitting 56 into the manifold chamber 44*a* from which it flows through adjacent openings 52*b* into the first ends 34 of the first set of alternate passageways 32*b*. This salt water then flows along the entire length of the first set of alternate passageways 32*b* to the second ends 36 thereof and thence into the manifold chamber 50*a*. From the manifold chamber 50*a*, the heated salt water then passes into the condenser/evaporator system.

The warm potable water which is derived as fresh water condensate from the condenser/evaporator system is directed into the conduit fitting 60 to pass into the manifold chamber 48*a*. From the manifold chamber 48*a*, this warm potable water passes through adjacent openings 52*c* into the second ends 36 of the second set of alternate passageways 32*c* in counterflow relationship to saline water in the first set of alternate passageways 32*b*. When this potable water reaches the first ends 34 of its related passageways 32*c*, it passes through adjacent openings 52*c* into the manifold chamber 46*a* to pass out the conduit fitting 58.

From an examination of FIG. 3, it can be seen that the vertically adjacent passageways 32 are separated only by the sheet portions 42. Thus, the fluid heat exchange medium in any one passageway 32 is in heat exchange relationship with the second heat exchange medium in the passageways 32 immediately above and below.

With thin film plastic being used for the sheets 14, if there is any significant pressure differential between any portion of two adjacent passageways 32, there will be some deflection of the intermediate sheet portion 42 from a planar configuration so that the sheet portion 42 becomes "rounded" in cross-sectional configuration. To discuss a further facet of the present invention as a counterflow heat exchanger, the passageways 32 could be pressurized in either of two ways. One method would be to pressurize the set of passageways for one fluid medium at a substantially higher pressure so that the pressure along the entire length of such passageways 32 would remain at a higher pressure than the alternate set of passageways 32 carrying the other fluid heat exchange medium. In this instance, the passageways carrying the first fluid medium would be expanded moderately in cross-sectional area along the entire length of the heat exchange passageways 32.

On the other hand, if the pressures of the two heat exchange mediums are more nearly equal, then a somewhat different configuration will result. Since the two heat exchange media are pumped into the passageways 32 at opposite ends of the heat exchange apparatus 10, and since each heat exchange medium will experience a pressure drop as it flows through the heat exchanger 10, one heat exchange medium will have a higher pressure at one end of the passageways 32, and the other heat exchange medium will have a higher pressure at the other end of the passageways 32.

The resulting configuration of the passageways 32 is that one set of alternate passageways 32 with the one fluid medium therein will have the outwardly rounded configuration at one end of the heat exchanger, while the other set of alternate passageways 32 carrying the other fluid medium, will have the outwardly rounded configuration at the opposite end of the heat exchange passageways 32. This particular arrangement can influence to some degree the rate of heat exchange between the two media. To explain this more fully, the rate of heat exchange, in addition to being influenced by the resistance to heat transfer at a heat exchange wall, is also influenced by the resistance of the fluid medium itself to transfer heat. It is known that if a liquid is passing over a heat exchange surface at a greater rate of speed, the resistance of the fluid to the transmission of the heat to the adjoining wall surface is diminished. The effect of this is that at the area where the heat exchange passageways are "rounded", so as to have a greater cross-sectional area, flow of liquid is at a lower velocity.

On the other hand, where the heat exchange passageways are diminished in cross-sectional area by having the adjacent passageways in a rounded configuration, the lineal velocity of the liquid flow is greater, so that there is less resistance to heat transfer by the liquid to the adjoining heat exchange surfaces 42. Since an increase in cross-sectional area decreases the rate of lineal velocity of the liquid to a lesser degree than a decrease in cross-sectional flow area of the same amount increases the lineal velocity, it can be surmised that in some circumstances there is a net gain in heat transfer effectiveness by virtue of the passageways 32 distorting moderately from a perfectly rectangular cross-sectional configuration.

In a typical commercial installation, where the present invention is used as a counterflow heat exchanger to warm salt water for subsequent processing through a condenser/evaporator heat exchanger, while not necessarily being limited to these dimensions, the sheets 14 could be made of two to four mil Tedlar (a trademark identifying a polyvinylflouride type plastic material), and would be made as thin as practical, consistent with the operational requirements of the configuration. The thickness of the sheets can be between about 0.0005 to 0.02 inch, and desirably between about 0.002 to 0.006 inch. The total length of the passageways 32 could be between about 8 to 30 feet. The width dimension of the passageways 32 could be between about 0.5 to 3 inch, and desirably between about 1 to 2 inch. The vertical dimension of the passageway 32 (i.e. the spacing between the sheets 14) could be between about 0.125 to 1.0, and desirably between about 0.25 to 0.5 inch.

When the heat exchange apparatus 10 is used as a coflow heat exchanger, then the two heat exchange mediums are directed into an adjacent set of conduit fittings, such as those at 56 and 58. One fluid medium then passes through the manifold 44*a* and into the first set of alternate passageways 32*b*, and the second fluid heat exchange medium passes through the manifold 46*a* into the second set of alternate passageways 32*c*, with the two fluid mediums then flowing in parallel relationship through adjacent passageways 32*b* and 32*c*. The two fluid mediums are then discharged through the two conduit fittings 60 and 62.

In some applications, it may be desirable to direct one fluid medium into the heat exchanger and at a higher pressure. Under this circumstance, one set of alternate passageways 32 would have more of an "expanded" or "rounded" configuration, so that its cross-sectional area would increase.

Within the broader aspects of the present invention, it is contemplated that the heat exchange apparatus 10 could be utilized as an evaporater/condensor type heat exchanger. In this instance, rather than the passageways 32 having a serpentine configuration, the passageways would be made substantially straight, and the apparatus 10 would be vertically oriented so that the passageways 32 would also be vertical. One heat exchange medium would be directed down one set of passageways as a thin falling film of liquid on the surfaces of the sheet portions 42, and a second vaporized heat exchange medium would be directed into the second set of alternate passageways 32 so as to form as condensate on the passageway walls.

Since the present invention is particularly adapted to provide an effective heat exchange apparatus by use of thin film plastic, the invention has been described herein as using such material for the sheets 14. However, within the broader aspects of the present invention, it is contemplated that other materials could be used to form the sheets 14, provided such material would have proper structural and heat exchange characteristics suitable for the particular application contemplated.

What is claimed is:

1. A heat exchange apparatus adapted to place a first fluid heat exchange medium into heat exchange relationship with a second heat exchange medium, said apparatus comprising:

a. a plurality of spacing plates, each of which has a perimeter portion and an interior portion providing at least one pair of elongate sidewalls defining a vertically through, horizontally extending elongate passageway which is open from a top surface to a bottom surface of its related plate, each of said passageways being arranged in a substantially identical pattern, said plates being stacked above one another in longitudinal and transverse alignment, with the perimeter portions being stacked in vertical alignment to form a perimeter of a heat exchange area, and with the interior portions being stacked in vertical alignment to position said passageways one directly above the other, each passageway having a first end and a second end, b. a plurality of thin film sheets, positioned intermittently between said spacing plates, with one sheet between each adjacent pair of spacing plates, so that each passageway is separated by a related pair of said sheets from the passageways immediately above and below, with each passageway being defined on side portions thereof by the sidewalls of the interior portion of its related plate, and on upper and lower portions by its related pair of sheets, c. a distributing means for said fluid medium, said distributing means comprising:

1. a first manifold means connecting to the first ends of a first set of alternately spaced passageways,
2. a second manifold means connecting to the first ends of a second set of alternately spaced passageways positioned alternately between the passageways of the first set,
3. a third manifold means connecting to the second ends of the first set of alternately spaced passageways,
4. a fourth manifold means connecting to the second ends of the second set of alternately spaced passageways, whereby said first heat exchange medium can be directed through said first set of alternately spaced passageway by means of said first and third manifold means, and said second heat exchange medium can be directed through such second set of alternately spaced passageways by means of said second and fourth manifold means, with heat exchange taking place across sheet portions separating vertically adjacent passageways, in a manner that one of said heat exchange mediums in one of said passageways is in heat exchange relationship with the other of said heat exchange mediums in the adjacent passageways immediately above and below.

2. The apparatus as recited in claim 1, wherein at least one of said manifold means comprises a plurality of vertically aligned through openings formed in said spacing plates forming a unitary manifold chamber, a set of alternate spacing plates being provided with feed passage means leading from said one manifold means into one of said sets of alternately spaced passageways.

3. The apparatus as recited in claim 1, wherein each of said manifold means comprises a plurality of vertically aligned through openings formed in said spacing plates, each set of aligned openings forming a related manifold chamber, with each manifold chamber being connected through feed passage means to its related set of passageways.

4. The apparatus as recited in claim 1, further comprising pressure means to press said spacing plates toward one another, said pressure means comprising containing means having therein a pressurized fluid medium which in turn exerts pressure against said spacing plates.

5. The apparatus as recited in claim 4, wherein said pressure means comprises at least one air bag having pressurized air therein, said air bag having a pressure surface pressing said spacing plates against one another.

6. The apparatus as recited in claim 5, wherein there is a first contact plate pressing against said spacing plates and a second pressure plate spaced from said contact plate, with said air bag being positioned between said contact plate and said pressure plate, said apparatus comprising means to press said pressure plate against said air bag so that a substantially uniform pressure is transmitted to said spacing plates by said air bag acting through said contact plate.

7. The apparatus as recited in claim 1, wherein each of said spacing plates has its related passageway arranged in a plurality of longitudinally extending, transversely spaced passageway sections, connected one to another in series relationship, with each of said passageway sections being longitudinally arranged in generally parallel relationship.

8. The apparatus as recited in claim 1, wherein:

a. each of said manifold means comprises a plurality of vertically aligned through openings formed in the spacing plates, each set of aligned openings forming a related manifold chamber, with each manifold chamber being connected through feed passage means to its related set of passageways, b. said apparatus further comprises pressure means to press the spacing plates toward one another, said pressure means comprising containing means having therein a pressurized fluid medium which in turn exerts pressure against the spacing plates, c. each of said spacing plates has its related passageway formed in a plurality of longitudinally extending, transversely spaced passageway sections, connected one to another in series relationship, with each of said passageway sections being longitudinally arranged in generally parallel relationship.

* * * * *